United States Patent [19]

Branibar

[11] 4,093,532

[45] June 6, 1978

[54] RECOVERY OF SILVER FROM PHOTOGRAPHIC FILM

[75] Inventor: Nick G. Branibar, Sparta, N.J.

[73] Assignee: Anken Industries, Morristown, N.J.

[21] Appl. No.: 761,376

[22] Filed: Jan. 21, 1977

[51] Int. Cl.[2] ..... C25C 1/20; C25C 7/00; C25C 7/02

[52] U.S. Cl. ..... 204/271; 204/109; 204/149; 204/268; 204/269

[58] Field of Search ..... 204/149, 130, 105 R, 204/109, 271, 275, 269, 268, 234, 208; 96/60 BF, 50 R

[56] References Cited

U.S. PATENT DOCUMENTS

| | | | |
|---|---|---|---|
| 1,925,322 | 9/1933 | Hills | 204/269 X |
| 1,959,531 | 5/1934 | Hickman et al. | 204/269 |
| 3,397,133 | 8/1968 | Sooryn | 204/208 |
| 3,451,906 | 6/1969 | Weed | 204/275 X |
| 3,658,683 | 4/1973 | Lagier et al. | 204/275 X |
| 3,715,291 | 2/1973 | Bentley | 204/275 X |
| 3,718,552 | 2/1973 | Mortell | 204/271 X |
| 3,779,889 | 12/1973 | Loftfield | 204/269 X |
| 3,964,990 | 6/1976 | Noyden | 204/275 X |
| 4,014,764 | 3/1977 | Seiler et al. | 96/60 BF |

*Primary Examiner*—Arthur C. Prescott
*Attorney, Agent, or Firm*—Cooper, Dunham, Clark, Griffin & Moran

[57] ABSTRACT

Apparatus for reclaiming silver from solution. Photographic film is transported through a plurality of compartments within which fluids act upon the constituents in the film coating. One of the compartments contains fluid that includes a silver complex dissolved therein, and a silver precipitating unit is positioned within that compartment. The precipitating unit includes anode-cathode elements connected to a source of electrical potential for depositing silver upon the elements.

5 Claims, 6 Drawing Figures

Fig. 1.
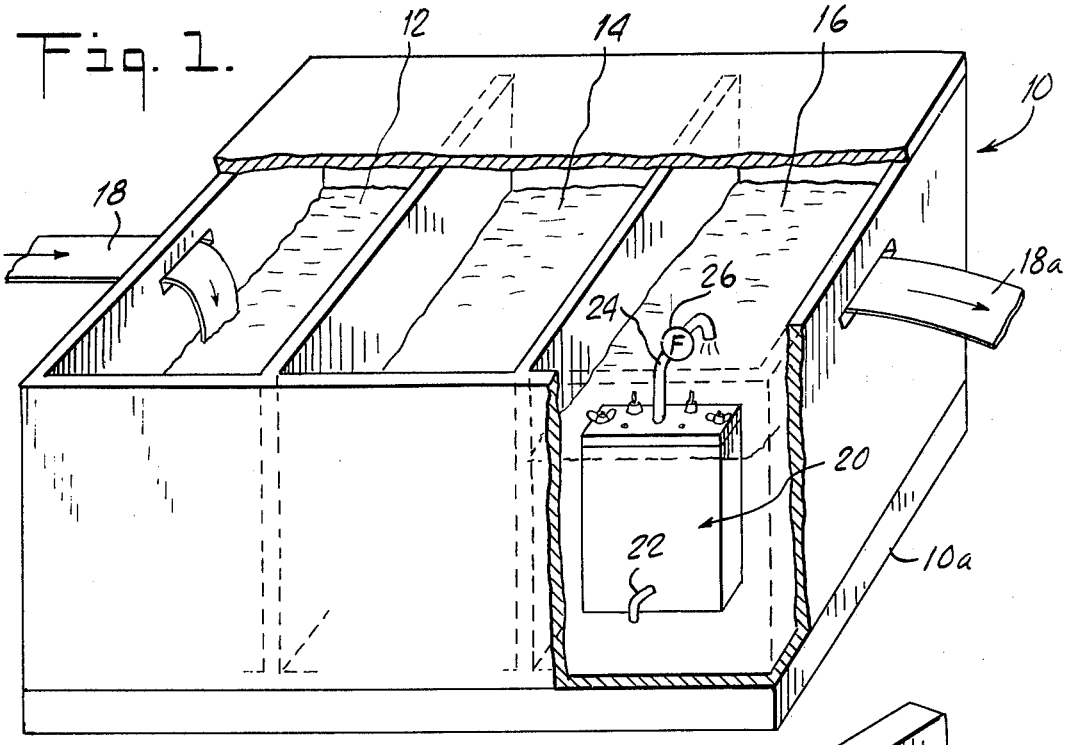
Fig. 2.
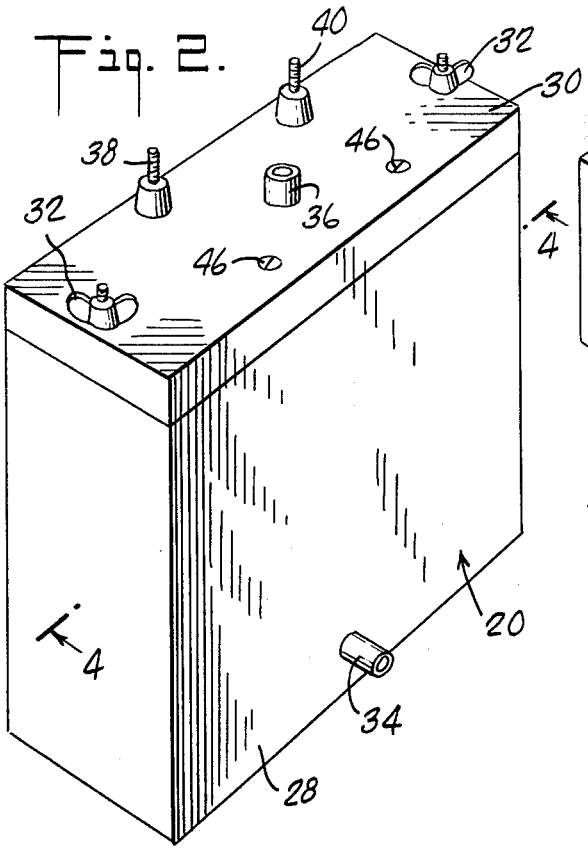
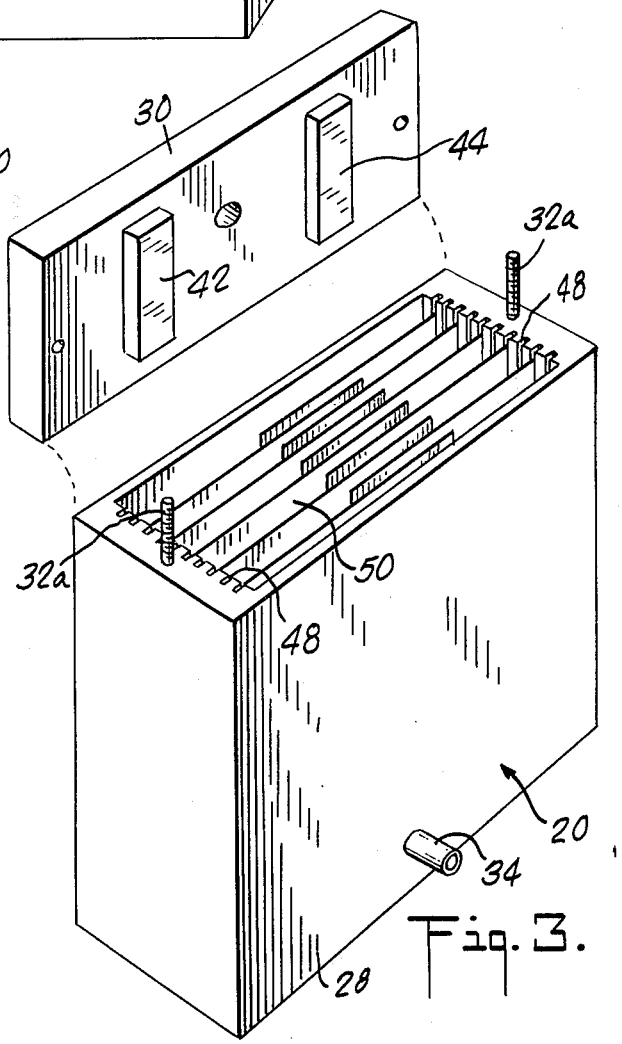
Fig. 3.

Fig. 4.
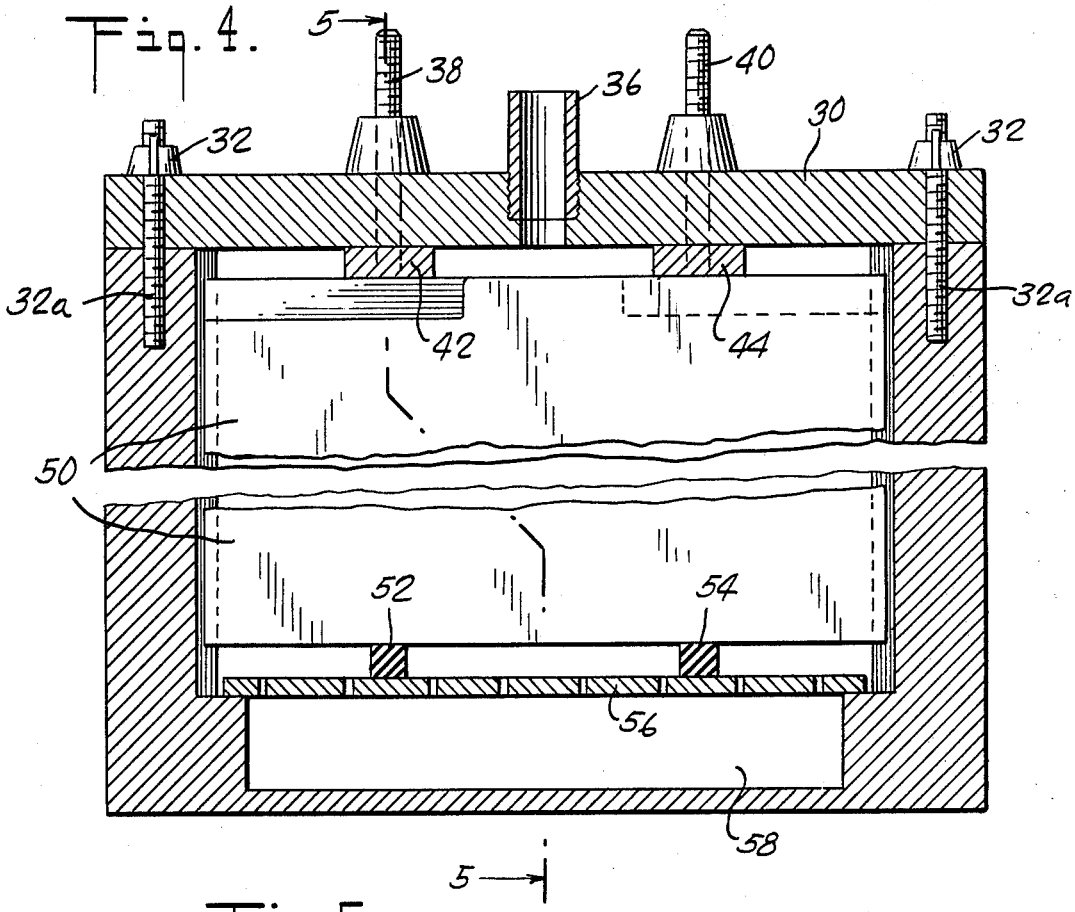
Fig. 5.
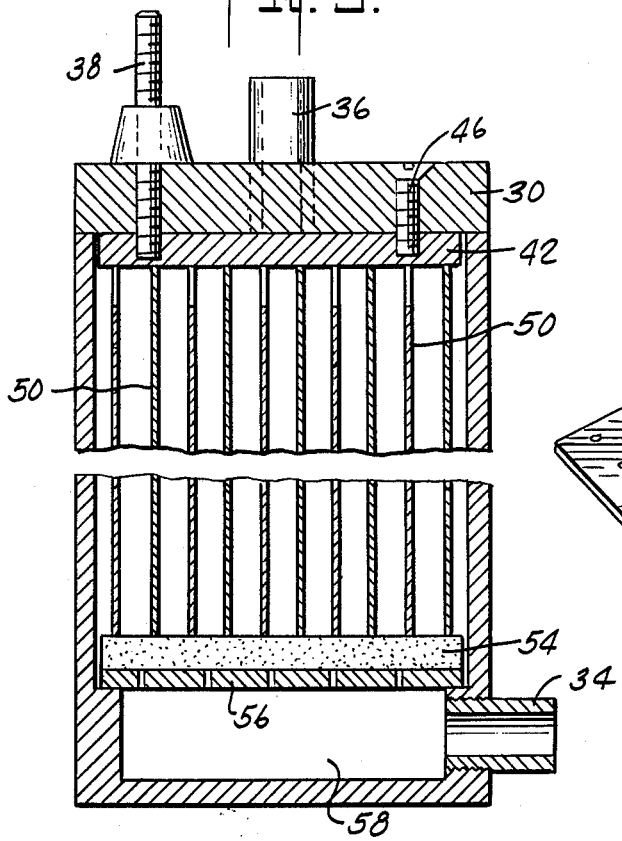
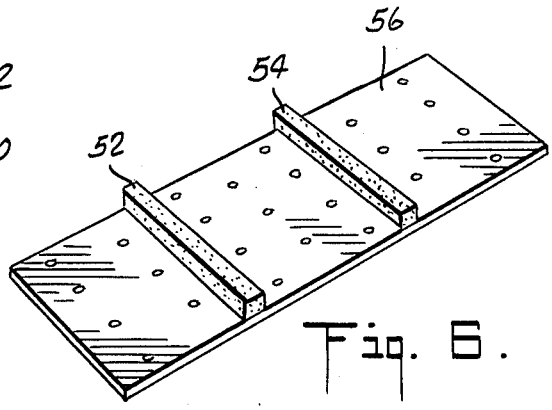
Fig. 6.

RECOVERY OF SILVER FROM PHOTOGRAPHIC FILM

BACKGROUND AND BRIEF DESCRIPTION OF THE INVENTION

This invention relates to the recovery of silver from photographic film. It has particular application to the recovery of silver from spent photographic film which is normally discarded.

In the normal processing (developing) of light-exposed photographic film, silver from the film coating enters into and is dissolved within the fixing solution used in the development process. It is desirable to reclaim such silver. It is also desirable to reclaim the silver from spent photographic film already developed, which has significant quantities of silver thereon. In the past it has been impractical to reclaim silver from used photographic film, especially since the most widely used method of recovering silver from scrap film is by the burning of the film base under controlled conditions and smelting the remaining ashes.

The present invention is directed to the reclaiming of silver derived from photographic film. A film processing unit is employed having a number of compartments through which the film is transported and containing fluids that act upon the constituents in the coating on the film. One of the compartments contains a fluid that includes a silver complex dissolved therein. In the case of spent photographic film, the processing unit is arranged to dissolve into solution the silver from the film, which is then removed from solution by a silver precipitating unit that includes anode-cathode elements connected to a source of electrical potential for depositing silver upon the elements. The precipitating unit is positioned within that compartment in which the silver complex is dissolved within the processing fluid. In the case of normal photographic development of light-exposed film, the precipitating unit is positioned within that compartment that contains the fixing solution used in the photographic process.

In this fashion, a soluble silver complex is precipitated out of solution to achieve the recovery of silver.

The invention will be more completely understood by reference to the following detailed description.

BRIEF DESCRIPTION OF THE DRAWING

FIG. 1 is a perspective view, partly broken away, of apparatus for reclaiming silver and constituting a presently preferred embodiment of the invention.

FIG. 2 is a perspective view of a silver precipitating unit useful in the system of FIG. 1.

FIG. 3 is a partly exploded view of the silver precipitating unit of FIG. 2.

FIG. 4 is a sectional view, to an enlarged scale, of the silver precipitating unit shown in FIG. 2, taken along the section 4—4.

FIG. 5 is a sectional view of the silver precipitating unit shown in FIG. 4, taken along the section 5—5.

FIG. 6 is a perspective view of a fluid distributing plate useful in the silver precipitating unit of FIGS. 2–5.

DETAILED DESCRIPTION

Referring to FIG. 1 a silver reclaiming unit 10 is shown. The unit 10 may be a conventional film processing unit of the type used for developing film in automatic typesetting operations. A typical processor is one sold by Anken Industries, Photo Products Group, 237 South Street, Morristown, New Jersey under its model PRC 10, as described in manual No. 874 entitled "Model PRC 10, Automatic Typesetting Processor, Installation Instructions, Service Data, Parts List". As described in this published manual, the processor includes three compartments 12, 14 and 16 through which a film 18 is transported for processing. As shown in FIG. 1, the film enters the processor from the left and exits the processor from the right. The movement through the compartments is automatic.

Each of the compartments contains fluid which acts upon the constituents of the film coating. For automatic typesetting operations, the fluids provide for the development of light-exposed film. In the case of reclaiming silver from spent or already developed photographic film, the compartments would contain fluids for first converting silver in the film to silver halide form and then dissolving that silver halide so that it may be electrodeposited out of solution.

Specifically, the solution in the first compartment 12 may be a solution of ferric chloride and water. The solution 12 may be a solution of ferric chloride and water. The solution may include some hydrochloric acid, or it may be one of ferric chloride and hydrochloric acid. The solution in this compartment converts the silver in the spent film to silver chloride form. The solution in the compartment 14 may comprise a sodium sulfite solution to neutralize the ferric chloride. The final solution in the compartment 16 may be a typical "fixing" solution, e.g., a thiosulfate solution which converts the silver halide to a soluble silver complex, namely, silver thiosulfate.

Positioned within the final compartment 16 is a silver precipitating unit 20, a presently preferred form of which is shown in FIGS. 2–6. The silver precipitating unit 20 receives solution from the compartment 16 via an inlet 22. This solution is pumped into the unit 20, and exits from the unit via an outlet 24 which may include a filter 26. Within the silver precipitating unit, silver is electrodeposited, as will be explained in more detail. The photographic film emerges from the processing unit 10 as at **18*a* with all of the silver removed and precipitated therefrom within the unit 20**.

The silver precipitating unit 20 is shown in more detail in FIGS. 2–6. Referring to these figures, the unit 20 comprises a housing 28 having a removable cover 30 held in place by wing nuts 32 secured to threaded rods **32*a*. The housing includes a fluid inlet 34 at the bottom thereof and a fluid outlet 36 from the removable cover. That cover also includes electrodes 38 and 40 which pass through the cover and make electrical contact with contacts 42 and 44. The contacts 42 and 44 are additionally held in place against the underside of the cover 30 by screws 46**.

Opposing walls of the precipitating unit are grooved as at 48 to receive the edge portions of anode-cathode plates 50. The anodes and cathodes of the precipitating unit are interleaved, and their top edges are stepped, as shown in FIG. 3, so that the anode elements make electrical contact with one of the contacts 42 and 44, and the cathode elements make electrical contact with the other contact.

The bottom edges of the anode-cathode plates rest on a support means constituting resilient support elements 52 and 54 carried by a perforated plate 56 at the lower portion of the silver precipitating unit 20. In this fashion, the anode-cathode plates 50 are resiliently held in place when the cover 30 of the precipitating unit is secured in place.

The perforated plate 56 closes off the top of a bottom compartment 58 which communicates with the fluid inlet 34. The combined area of the perforations in the plate 56 is less than the area (cross-sectional) of the fluid inlet 34. The fluid passing within the inlet 34 is under pressure, and because of this relationship of areas, the fluid exits from the compartment 58 upwardly under pressure past the anode-cathode plates 50, to exit from the precipitating unit via the outlet 36.

When the electrodes 38 and 40 are connected to a suitable source of potential, e.g., one to three volts, a current of from about zero to six amperes flows within the precipitating unit between the anode-cathode plates, depending upon the silver concentration within the solution. The anodes may be of graphite, while the cathodes may be of stainless steel, or both electrodes could be stainless steel, for example. Cathodic deposition takes place of silver upon the cathode plates. By monitoring the current flowing in the precipitating unit and noting when it increases sharply, the shorting out of anode and cathode plates can be detected. At that time, the processing unit 10 is shut off, and the precipitating unit 20 is serviced by removing the top cover 30, and exchanging the anode-cathode plates. The silver may be easily scraped from the anode-cathode plates.

Referring again to FIG. 1, the silver precipitating unit 20 is easily and advantageously immersed within the solution contained in compartment 16. The level of the solution is typically maintained just below the top of the precipitating unit so as not to short out the electrodes 38 and 40. The pump (not shown) for pumping the fluid through the precipitating unit 20 is typically carried in the bottom portion 10*a* of the unit 10.

In the case of reclaiming silver from spent photographic film, the processing unit 10 shown in FIG. 1 advantageously may be made of titanium metal in those parts exposed to the various fluids. The solution in the compartment 12 may be a typical ferric chloride solution. A representative and presently preferred solution constitutes a range of 0% - 10% hydrochloric acid and 5% to 60% ferric chloride. A replenishing solution of ferric chloride and hydrochloric acid in the above ranges has been used to replenish this solution within the compartment 12.

When the silver precipitating unit 20 is to be used in a conventional processor for the development of film, in order to reclaim silver from the fixing solution, normally that precipitating unit would be positioned within the second compartment 14, which, in that case, would contain the fixing solution. The first compartment 12 would contain the conventional developing solution, and the final compartment 16 would contain the washing solution.

Suitable solutions for the reclaiming of silver from spent photographic film are disclosed in the following patents: MacDonald U.S. Pat. No. 1,582,847 issued Apr. 27, 1926; Anderson U.S. Pat. No. 3,733,256 issued May 15, 1973.

Patents disclosing the use of precipitating plates in silver deposition units (not electrically energized) are disclosed in Judd U.S. Pat. No. 951,372 issued Mar. 8, 1910 and Wiswall et al U.S. Pat. No. 549,177 issued Nov. 5, 1895.

It will be appreciated that modifications of the presently preferred embodiment disclosed above are possible. For example, various contact structures may be utilized in the silver precipitating unit. That unit may basically be constructed of plastic or other material non-reactive with the solution into which it is immersed. Alternatively, the side plates of the precipitating unit may be cathode or anode elements to increase the active elements within the unit. Accordingly, the invention should be taken to be defined by the following claims.

What is claimed is:

1. Apparatus for the electrodeposition of silver from solution comprising a housing having a removable cover and walls with grooves therein, anode-cathode plates within said housing and positioned with edge portions thereof within said grooved walls, said anode-cathode plates being maintained in spaced relation from one another, said removable cover including electrical contacts on the underside thereof in electrical contact-making engagement with said anode-cathode plates, said housing including a fluid inlet and outlet and a bottom compartment for receiving fluid under pressure from said fluid inlet and closed by a perforated plate at its top portion, the combined area of said perforations being less than the area of said fluid inlet, and support means of resilient material positioned on the upper surface of said perforated plate for supporting the lower edges of said anode-cathode plates in spaced relation from said perforated plate.

2. Apparatus according to claim 1 in which said support means is of resilient material and is positioned on the upper surface of said perforated plate.

3. Apparatus as in claim 1, in which said electrical contacts on the underside of said cover urge said lower edges of said anode-cathode plates against said resilient material.

4. Apparatus as in claim 1 and suitable for the reclaiming of silver from the silver-bearing coating on photographic film, including a container having a plurality of compartments through which said film is transported and containing fluids acting upon the constituents in said coating, one of said compartments containing fluid that includes a silver complex dissolved therein, said housing being positioned within said one compartment for passage therethrough of the fluid within that compartment and deposition of silver upon said anode-cathode plates.

5. Apparatus as in claim 4, in which said housing is positioned within said one compartment so that the level of fluid in that compartment is just below the top of said housing so as not to electrically short said electrical contacts.

* * * * *

UNITED STATES PATENT AND TRADEMARK OFFICE

CERTIFICATE OF CORRECTION

PATENT NO. : 4,093,532

DATED : 6 June 1978

INVENTOR(S) : Nick G. Branibar

It is certified that error appears in the above-identified patent and that said Letters Patent are hereby corrected as shown below:

Column 2, Lines 22 to 24, delete "The solution 12 may be a solution of ferric chloride and water."

Column 4, Lines 38 to 40, delete Claim 2.

On the cover sheet "5 claims" should read -- 4 claims --.

Signed and Sealed this

Sixth Day of March 1979

[SEAL]

*Attest:*

RUTH C. MASON
*Attesting Officer*

DONALD W. BANNER
*Commissioner of Patents and Trademarks*